US010815110B2

(12) United States Patent
Ketchum et al.

(10) Patent No.: US 10,815,110 B2
(45) Date of Patent: Oct. 27, 2020

(54) LIQUID PRODUCT DISPENSING SYSTEM

(71) Applicant: Fronhofer Design LLC, Cossayuna, NY (US)

(72) Inventors: Benjamin Ketchum, Moreau, NY (US); Paul Fronhofer, Salem, NY (US)

(73) Assignee: Fronhofer Design LLC, Cossayuna, NY (US)

( * ) Notice: Subject to any disclaimer, the term of this patent is extended or adjusted under 35 U.S.C. 154(b) by 10 days.

(21) Appl. No.: 16/165,403

(22) Filed: Oct. 19, 2018

(65) Prior Publication Data

US 2019/0330037 A1 Oct. 31, 2019

Related U.S. Application Data

(60) Provisional application No. 62/663,571, filed on Apr. 27, 2018.

(51) Int. Cl.
*B67C 3/20* (2006.01)

(52) U.S. Cl.
CPC ..... *B67C 3/202* (2013.01)

(58) Field of Classification Search
CPC ..... B67C 3/202
USPC ..... 141/83
See application file for complete search history.

(56) References Cited

U.S. PATENT DOCUMENTS 4,582,102 A * 4/1986 Risser ..... B67C 3/202 141/144
6,644,344 B2 * 11/2003 Tibbott ..... G01F 1/76 137/2

FOREIGN PATENT DOCUMENTS

DE 3740876 A1 * 6/1989 ..... B67C 3/202

* cited by examiner

*Primary Examiner* — Craig M Schneider
*Assistant Examiner* — Jason K Niesz
(74) *Attorney, Agent, or Firm* — Maxine L. Barasch; Keohane & D'Alessandro, PLLC

(57) ABSTRACT

Disclosed embodiments provide a liquid product dispensing system. Cans are transported onto a weigh plate. The weigh plate is coupled to a dispensing system such that, when the can is filled with product to a predetermined weight, the dispensing system stops the flow of product into the can. A transport system then moves the filled cans from the weigh plate and moves another set of empty cans onto the weigh plate, and the process continues, enabling high-speed production of canned beverages.

14 Claims, 21 Drawing Sheets

LIQUID PRODUCT DISPENSING SYSTEM

CROSS REFERENCE TO RELATED APPLICATIONS

This application claims priority to U.S. Patent Application Ser. No. 62/663,571, filed on Apr. 27, 2018, the entire contents of which are incorporated herein by reference.

FIELD OF THE INVENTION

The present invention relates generally to liquid product dispensing systems, and more particularly, to liquid product dispensing systems for beverage containers.

BACKGROUND

The process of beer making requires adherence to strict standards in order to create a quality beer with uniform consistency and flavor from can to can. Beer production typically includes the steps of brewing, fermentation, and clarification. The finished product is placed into cans or bottles for distribution and consumption. In addition to beer, soft drinks and other beverages are also distributed in bottles and cans. Soft drinks include all drinks made from water or mineral water, sodas, and other drinks. The beverages often contain carbon dioxide and/or Nitrogen. Other beverage products such as flavored water, sports and energy drinks, lemonades, fruit punches, and ice teas use a similar manufacturing process. Cans have certain advantages over bottles in certain situations. They block light transmission and are less prone to breakage. Thus, cans continue to be a popular container in which to store beverages. It is therefore desirable to have improvements in beverage canning.

SUMMARY

In one embodiment, there is provided a liquid product dispensing system, comprising: a balance apparatus, the balance apparatus comprising: a balance arm; a weigh plate disposed on a distal end of the balance arm; a counterweight adjustably disposed on the balance arm; a fulcrum block disposed at an intermediate position on the balance arm, wherein the balance arm is configured and disposed to pivot at the fulcrum block; a sensor configured and disposed to generate a trigger event in response to a predetermined weight being loaded on the weigh plate; a dispensing system comprising a liquid dispensing port, and wherein the dispensing system is configured and disposed to stop dispensing upon detecting the trigger event from the sensor.

In another embodiment, there is provided a liquid product dispensing system, comprising: a product weighing system, comprising: a weigh plate; a strain gauge mechanically coupled to the weigh plate; an electronic circuit configured and disposed to generate a trigger event in response to a predetermined strain indicated by the strain gauge; a dispensing system comprising a liquid dispensing port, and wherein the dispensing system is configured and disposed to stop dispensing upon detecting the trigger event from the electronic circuit.

In yet another embodiment, there is provided a computer-implemented method for dispensing liquid product, comprising: activating a weigh plate lockdown mechanism for a weigh plate; operating a transport mechanism to place a can on the weigh plate; deactivating the weigh plate lockdown mechanism; starting product dispensing into the can; in response to detecting a full condition for the can, ending product dispensing; reactivating the weigh plate lockdown mechanism; and operating the transport mechanism to remove the can from the weigh plate.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

The drawings are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

DETAILED DESCRIPTION

Figure 1A:
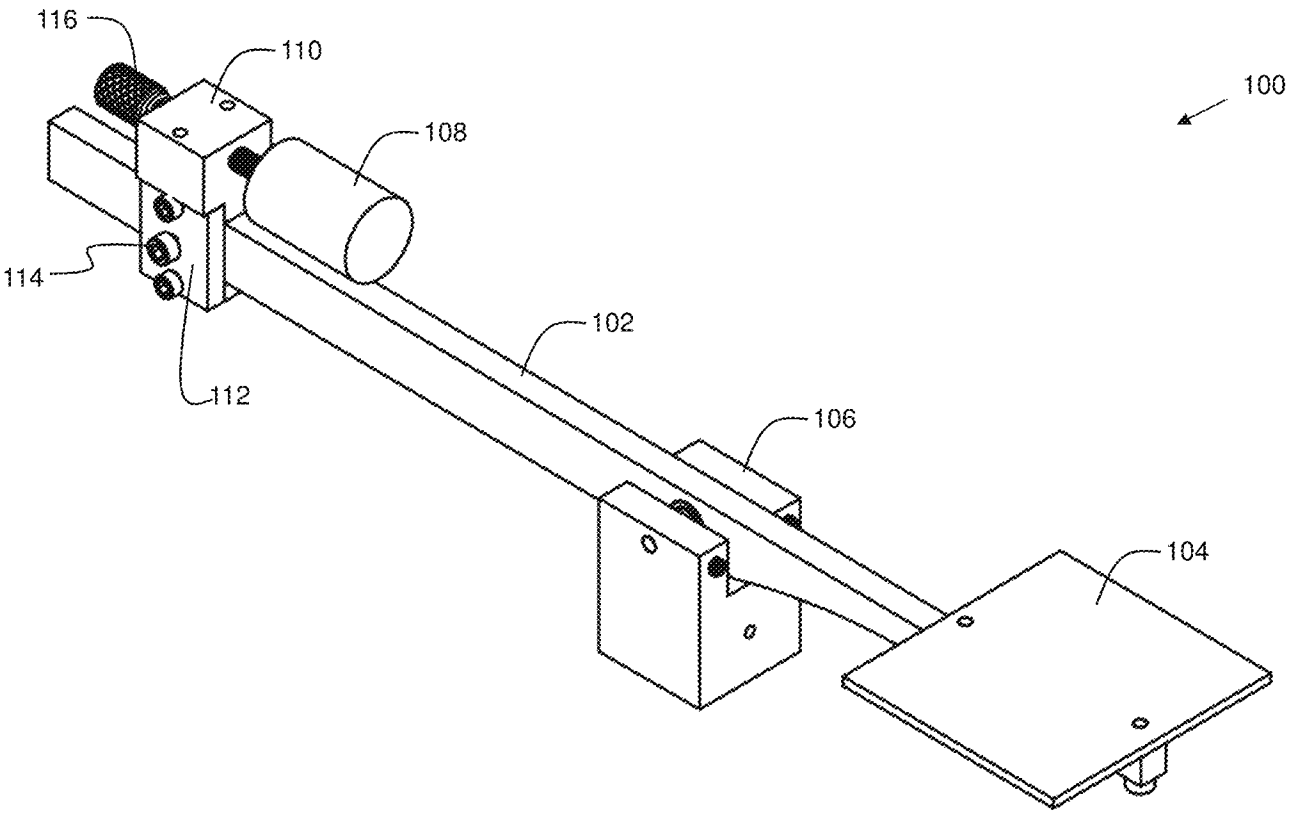
FIG. 1A is a perspective view of a balance apparatus in accordance with embodiments of the present invention.

Disclosed embodiments provide a liquid product dispensing system. Cans are transported onto a weigh plate. The weigh plate is coupled to a dispensing system such that, when the can is filled with product to a predetermined weight, the dispensing system stops the flow of product into the can. A transport system then moves the filled cans from the weigh plate and moves another set of empty cans onto the weigh plate, and the process continues, enabling high-speed production of canned beverages.

Disclosed embodiments provide improvements over mechanisms that use a timed fill cycle for cans. In various production environments, fill pressure is not constant, and often decreases over time. This means that the time required to fill a first can may be less than the time required to fill the thousandth can. When cans are underfilled or overfilled, the product typically is discarded during the quality control process, which adversely impacts product yield. Disclosed embodiments can improve product yield by ensuring the beverage cans are filled to the proper level. With disclosed embodiments, the can is filled to the same level, even if the fill rate varies.

Embodiments include weighing a beverage container to determine when the beverage container has been sufficiently filled for packaging. Disclosed embodiments utilize an individual balance system to maintain a specific weight that is predetermined by the operator. Once the predetermined weight has been reached by dispensing product into the container, the balance trips a sensor to signal the product dispensing to stop.

Embodiments of the invention include a weigh plate on one side of a balance arm, and an adjustable counterweight on an opposite side of the balance arm. A fulcrum block houses bearings that the balance arm actuates on. In embodiments, the counterweight has a dual adjustment, including a coarse adjustment and a fine adjustment. The entire counterweight assembly is slidable along the balance arm and able to be locked into place along the balance arm as a large-scale adjustment mechanism. Embodiments also include a fine thread thumb screw attached to the counterweight cylinder, which acts as a fine adjustment mechanism. Disclosed embodiments can accommodate 8-ounce to 20-ounce beverage containers with varying degrees of densities of the dispensed product. One of ordinary skill in the art could modify embodiments to accommodate other sized beverage containers, and accordingly, all of such are included within the scope of the invention.

In embodiments, as the container reaches the predetermined weight and activates the sensor mounted below, the balance arm activates a sensor coupled to the weigh plate, and the weigh plate comes to a rest on a center stopping block. The center stopping block acts as unified stop for each of the weigh plates as well as a leveling block to ensure that the plates are even and flush with one another when the weigh plate lockdown mechanism is activated.

Embodiments are designed to accommodate two lanes of four beverage containers, split on either side of the stopping block. As four containers are filled on their respective side, and all four sensors are triggered, signaling the end of flow for all fill heads, an actuator locks the weigh plates into place creating a flat plane to enable the beverage containers to exit via a transport mechanism.

Alternative embodiments include the use of wash-down rated electric strain gauges in lieu of the mechanical balance system. In these embodiments, the predetermined weight can be calibrated via a user interface on an electronic display. These embodiments will be further explained in the following detailed description.

Figure 1B:
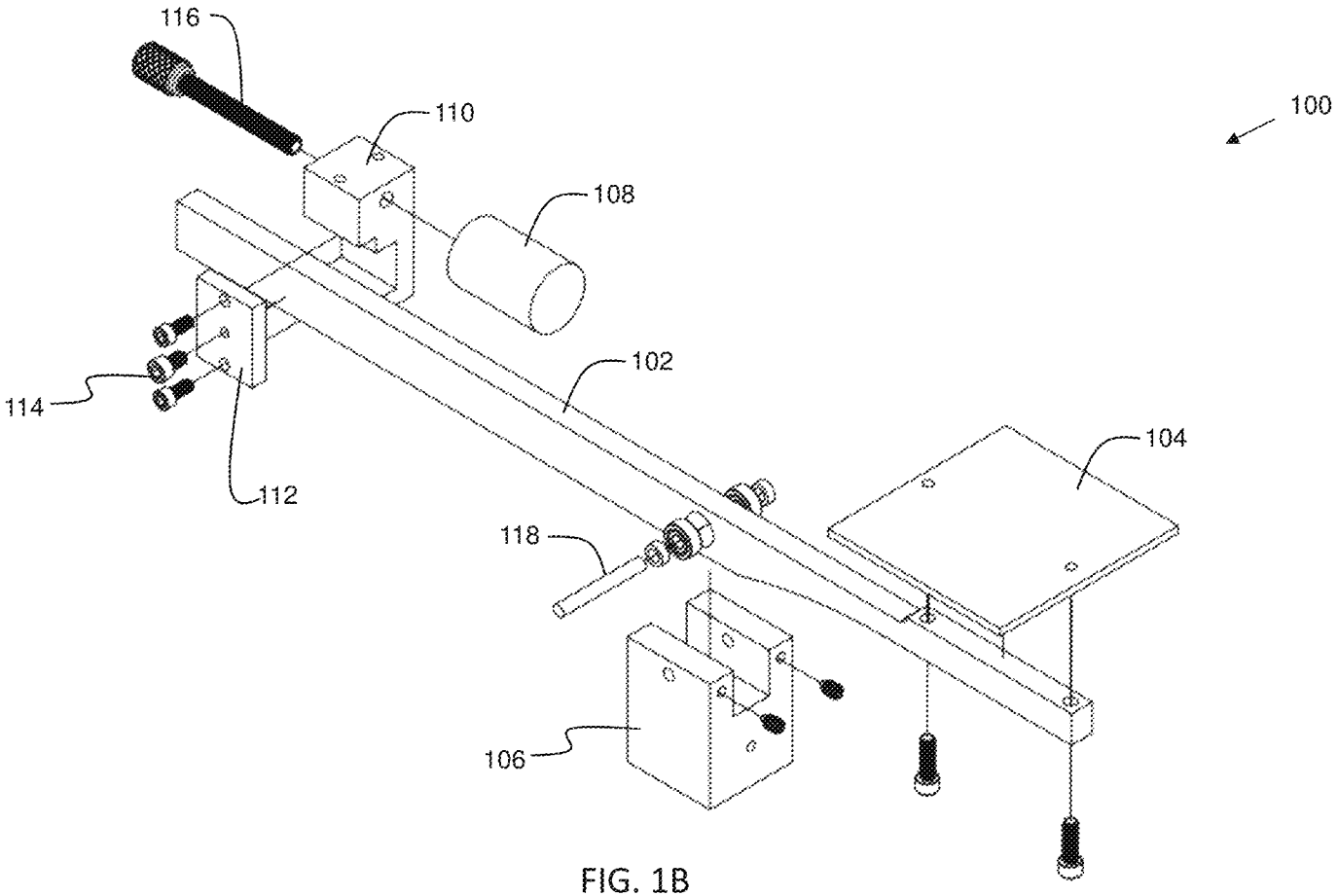
FIG. 1B is an exploded view of a balance apparatus in accordance with embodiments of the present invention.

FIG. 1A is a perspective view of a balance apparatus 100 in accordance with embodiments of the present invention, and FIG. 1B is an exploded view of the balance apparatus of FIG. 1A. Balance apparatus 100 includes a balance arm 102 that is pivotably mounted to fulcrum block 106. The fulcrum block 106 is disposed at an intermediate position on the balance arm 102. A weigh plate 104 is disposed on a distal end of the balance arm 102. A counterweight 108 is disposed on the opposite side of the weigh plate 104, with respect to the fulcrum block 106. In embodiments, the weigh plate 104 has a rectangular top surface 105. In some embodiments, the weigh plate top surface 105 has a surface area ranging from 9 square inches to 16 square inches.

The counterweight 108 is affixed to a counterweight block 110 by adjustment screw 116. The counterweight block 110 is affixed to the balance arm 102 by counterweight block constraint 112 and held in place by set screw 114. A pivot pin 118 (FIG. 1B) traverses the fulcrum block 106 and the balance arm 102 to enable the balance arm to pivot about the fulcrum block. Thus, in embodiments, the counterweight is coupled to a slide block, wherein the slide block is configured and disposed to adjustably attach to the balance arm. Some embodiments include a screw coupled to the counterweight and the slide block, wherein the screw is configured and disposed to adjust the position of the counterweight relative to the fulcrum block. In some embodiments, the screw has a thread count ranging from 20 threads per inch to 40 threads per inch.

As part of a setup procedure, an operator loosens set screw 114 to slide the counterweight block 110 to a position where the balance arm is approximately balanced about the fulcrum block 106 when a full can is placed on weigh plate 104. Fine adjustment can then be achieved by turning adjustment screw 116 to move the counterweight 108 closer to, or further away from, the fulcrum block 106, to ensure that the weigh plate 104 is in its lowest orientation when a full can is placed on the weigh plate 104. This enables a simple, reliable, and cost-effective mechanism for determining when the beverage container (can) is full.

Figure 2A:
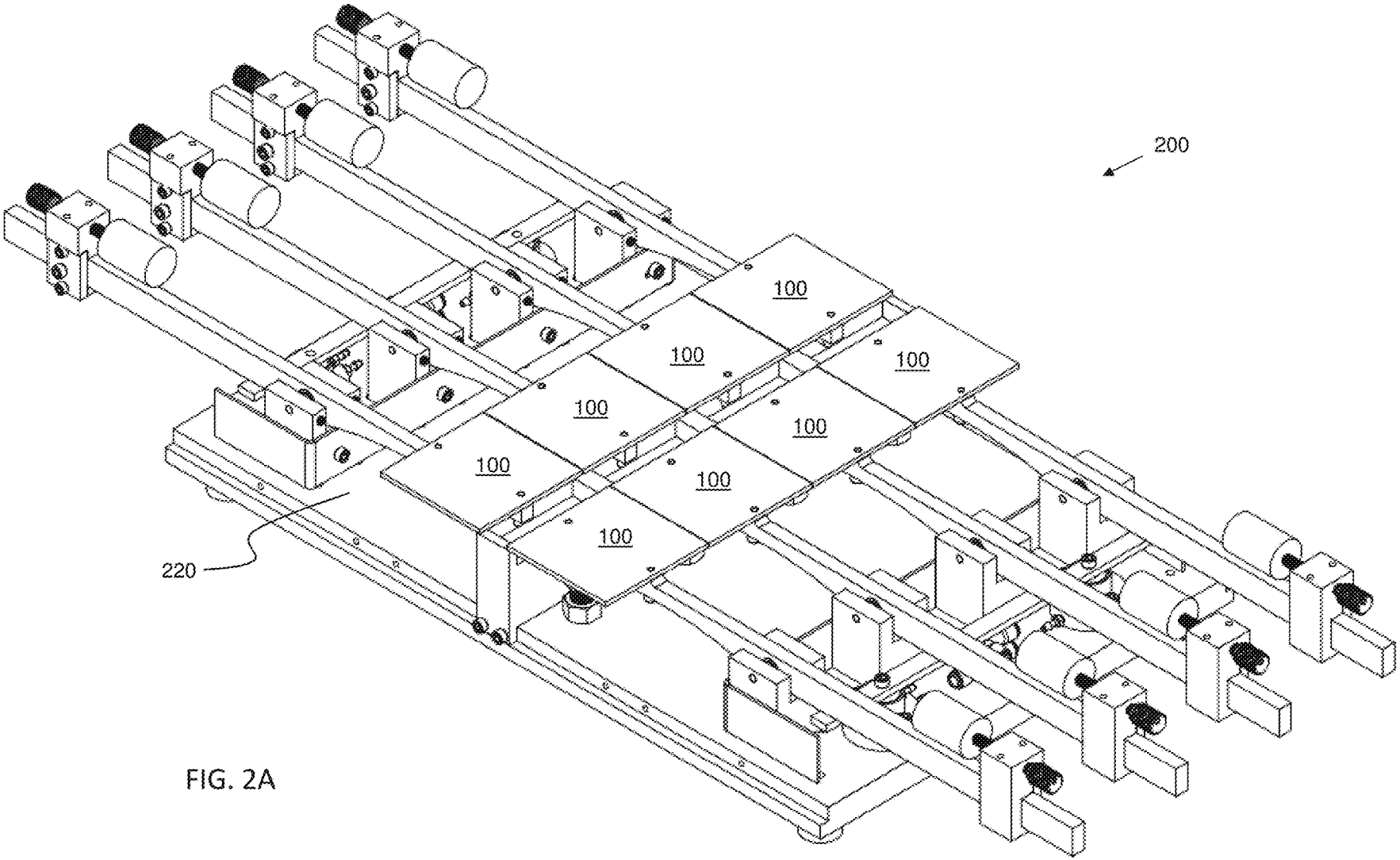
FIG. 2A is a perspective view of a bank of balance apparatuses in accordance with embodiments of the present invention.
Figure 2B:
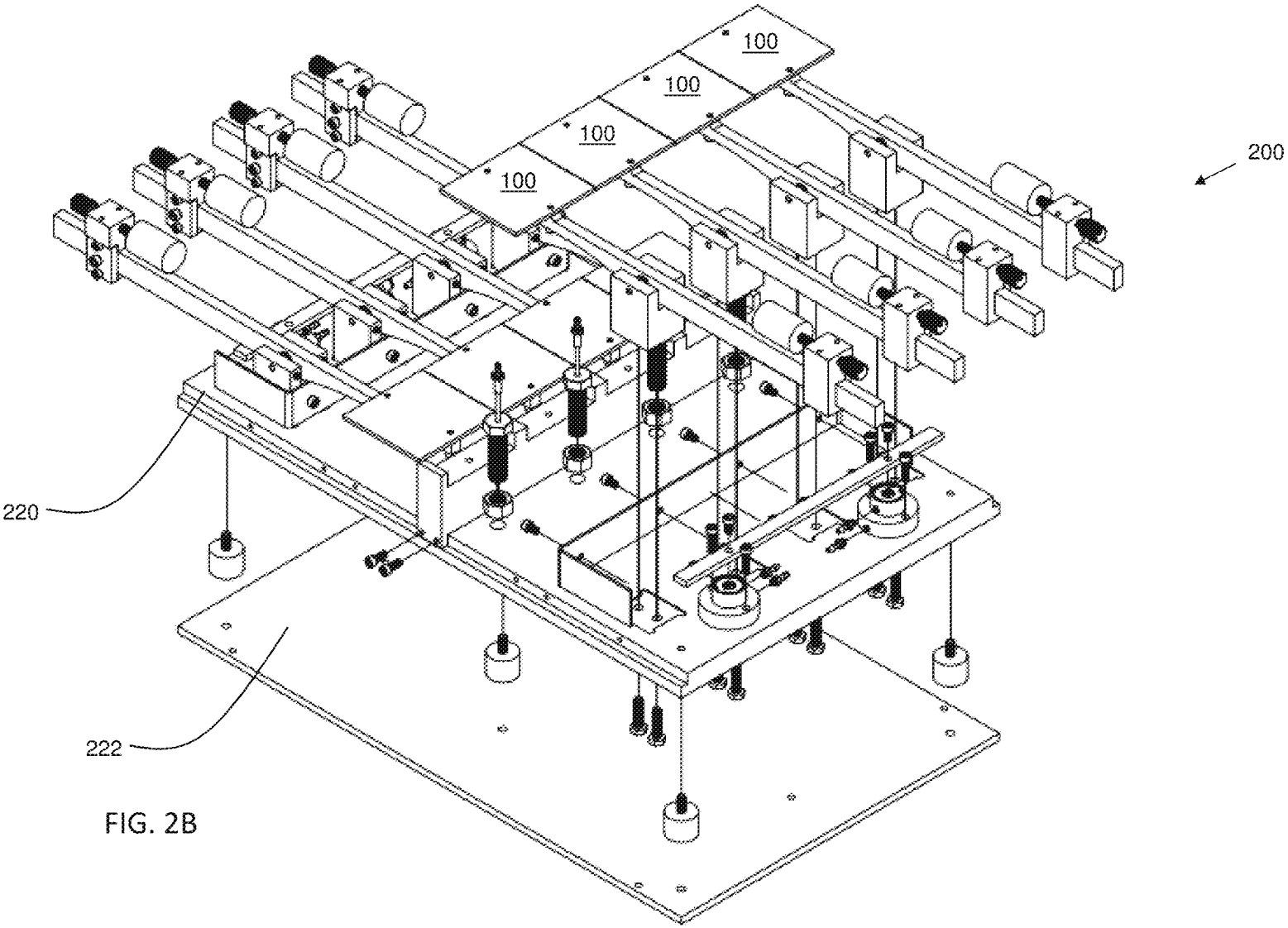
FIG. 2B is an exploded view of a bank of balance apparatuses in accordance with embodiments of the present invention.
Figure 2C:
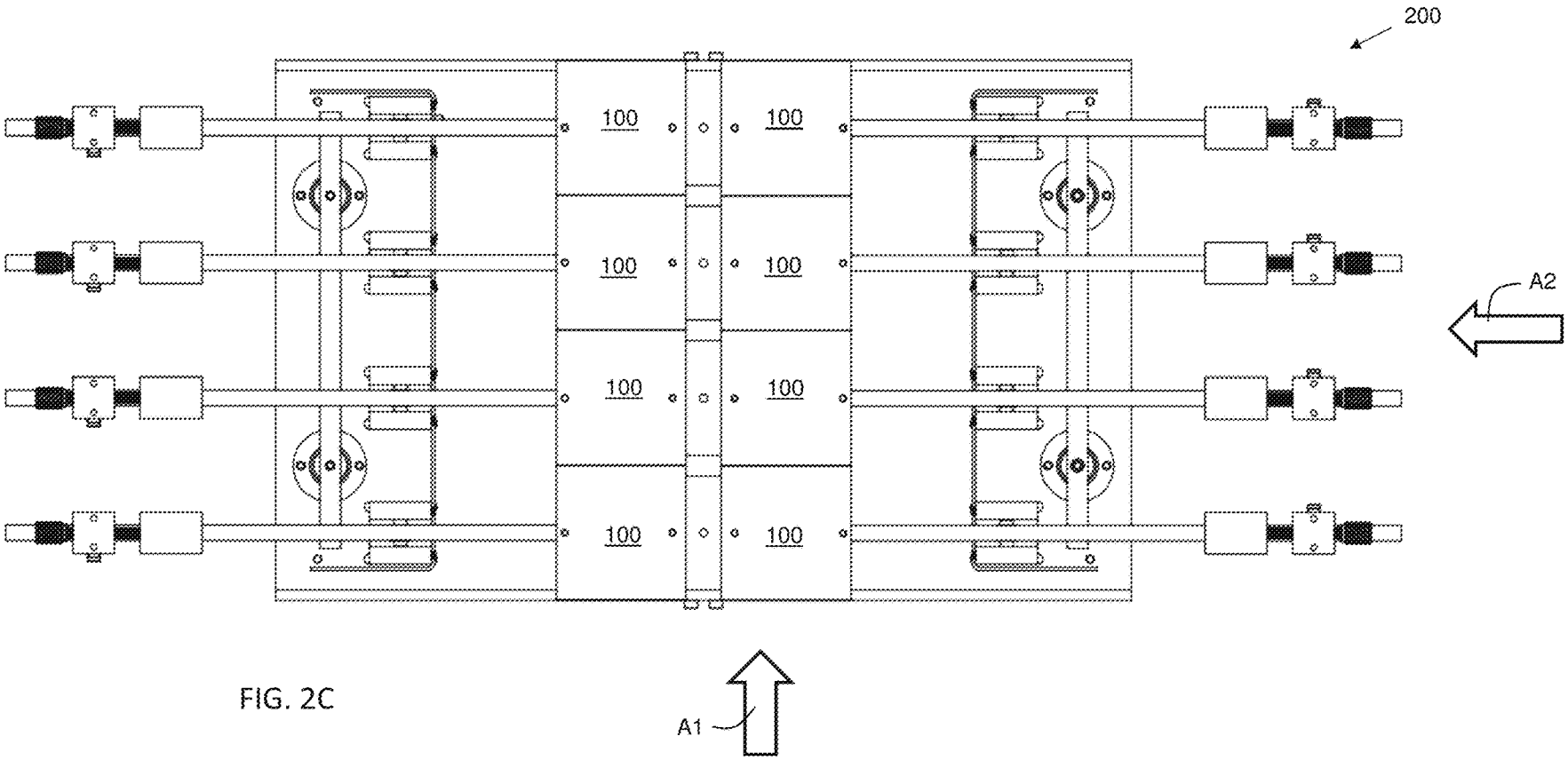
FIG. 2C is a top-down view of a bank of balance apparatuses in accordance with embodiments of the present invention.
Figure 2D:
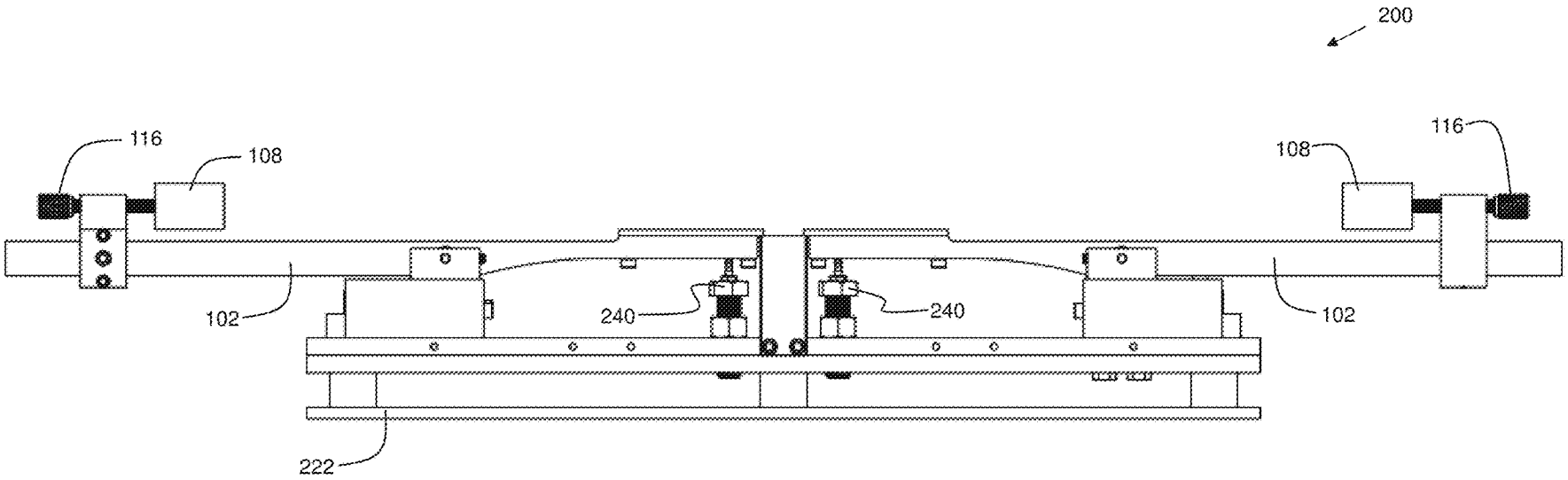
FIG. 2D is a first side view of a bank of balance apparatuses in accordance with embodiments of the present invention.
Figure 2E:
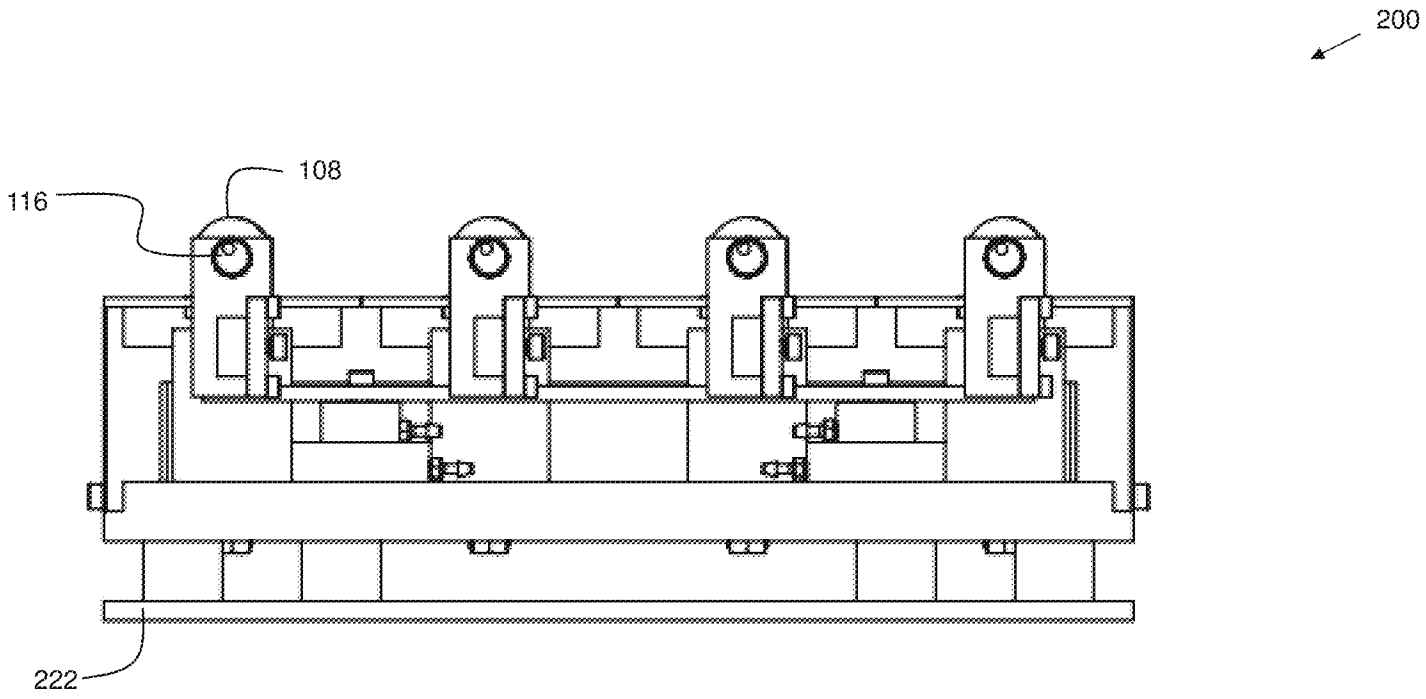
FIG. 2E is a second side view of a bank of balance apparatuses in accordance with embodiments of the present invention.

FIG. 2A is a perspective view of a bank 200 of balance apparatuses in accordance with embodiments of the present invention. FIG. 2B is an exploded view of the bank of FIG. 2A. FIG. 2C is a top-down view of the bank of FIG. 2A. FIG. 2D is a first side view of the bank of FIG. 2A as viewed facing the direction indicated by arrow A1 of FIG. 2C. FIG. 2E is a second side view of the bank of FIG. 2A as viewed facing the direction indicated by arrow A2 of FIG. 2C. As shown in FIGS. 2A-2E, there are 8 balance apparatuses 100 arranged in a 4×2 configuration. The bank of 8 balance apparatuses is mounted on a platform 220, which is mounted on a base 222 (as shown in FIG. 2B). Note that while 8 balance apparatuses are shown in FIGS. 2A-2E, embodiments may have more or fewer than 8 balance apparatuses per bank.

Figure 3:
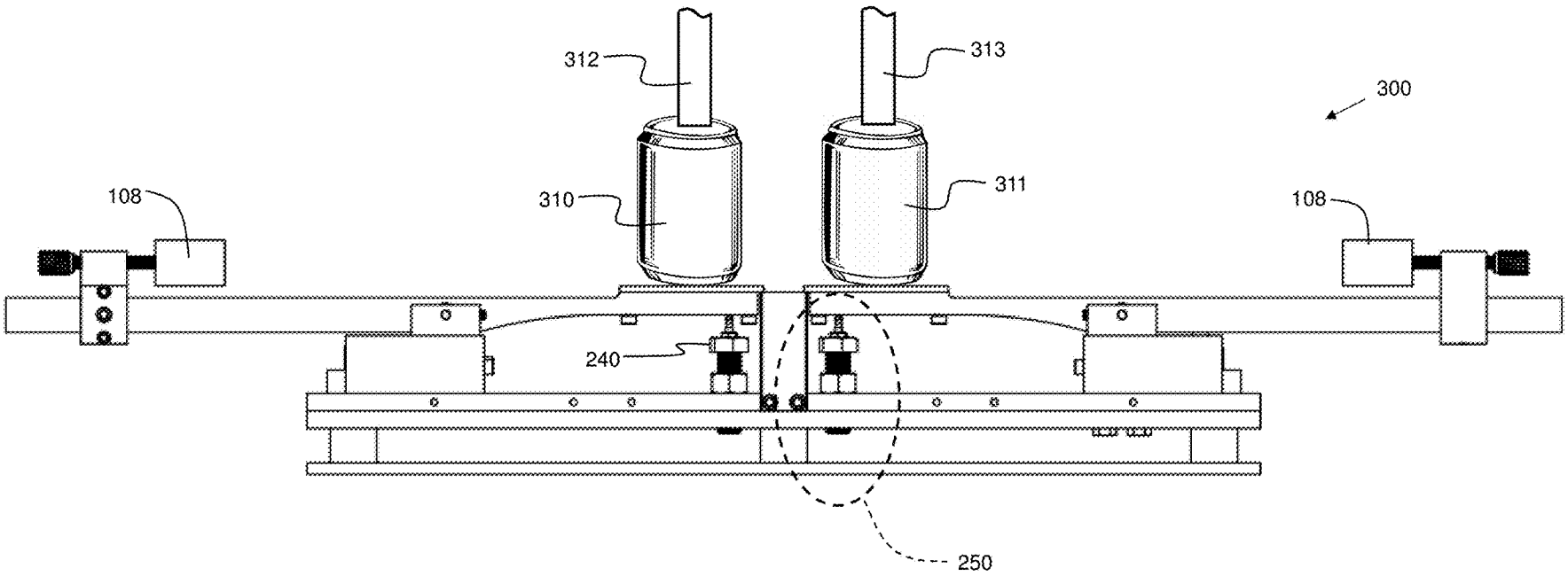
FIG. 3 is a side view of a liquid dispensing system in accordance with embodiments of the present invention.

FIG. 3 is a side view of a liquid dispensing system 300 in accordance with embodiments of the present invention with can 310 and can 311 each disposed on a balance apparatus. A dispensing tube 312 is placed above can 310, and fills can 310 with a product, such as beer, soda, water, tea, or the like. Tube 312 serves as a liquid dispensing port. Similarly, a dispensing tube 313 is placed above can 311, and fills can 311 with a product. When the weight of the dispensed product exceeds the opposing force of the counterweight 108, the sensors 240 are tripped by the balance arm, causing a trigger event. The tripping of the sensors 240 is configured and disposed to generate an electrical signal that causes the dispensing via tubes 312 and 313 to terminate and activate a transport mechanism to move the filled cans 310 and 311 to subsequent stages of the canning process (e.g. sealing, labeling, etc.). Area 250 defines a detail area for the fill sensors. An advantage of this embodiment is that the filling of a particular can is independent of the filling of other cans within the bank. As an example, if can 310 in FIG. 3 completes filling before can 311, then the dispensing is stopped on tube 312 while tube 313 can continue to dispense until can 311 is full. When all the cans within a bank are full, then the transport system can move all the cans off the liquid product dispensing system for further processing.

Figure 4A:
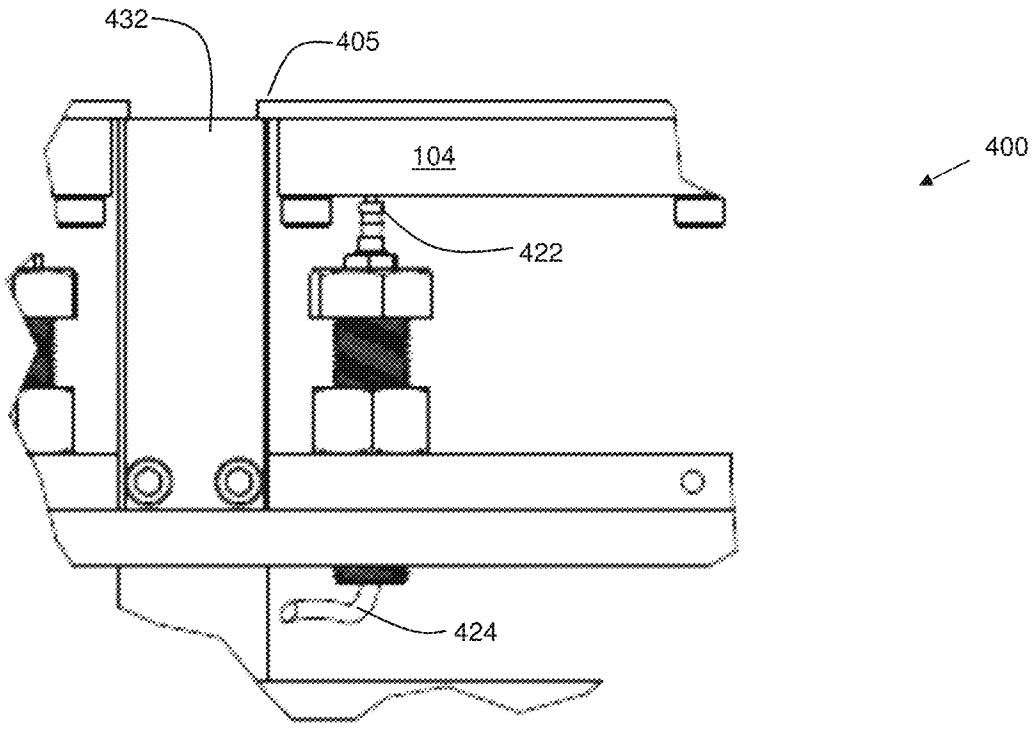
FIG. 4A shows additional detail of a fill sensor in an embodiment of the present invention.

FIG. 4A shows additional detail 400 of a fill sensor in an embodiment of the present invention. FIG. 4A shows details of the area denoted by 250 in FIG. 3. As can be seen in FIG. 4A, a contact sensor 422 is activated when the weigh plate 104 pushes down on the sensor 422 with sufficient force, due to the weight of a filled can. When the contact sensor 422 is activated, an electrical signal is transmitted via wire 424 to a controller, such as a microprocessor, microcontroller, programmable controller, or other suitable processor-based electronic device. Thus, in embodiments, the sensor comprises a contact sensor.

The top surface 405 of weigh plate 104 extends over a stopping block 432 to prevent travel beyond a horizontal orientation. Thus, when the weigh plate 104 is in its lowest position, the stopping block 432 ensures that the top surface 405 (like 105 of FIG. 1A) is in a horizontal orientation. The horizontal orientation allows filled cans to be removed, and another set of empty cans to be positioned on the weigh plates for filling. Thus, embodiments include a stopping block configured and disposed to prevent downward travel of the weigh plate when the weigh plate is in a horizontal orientation.

Figure 4B:
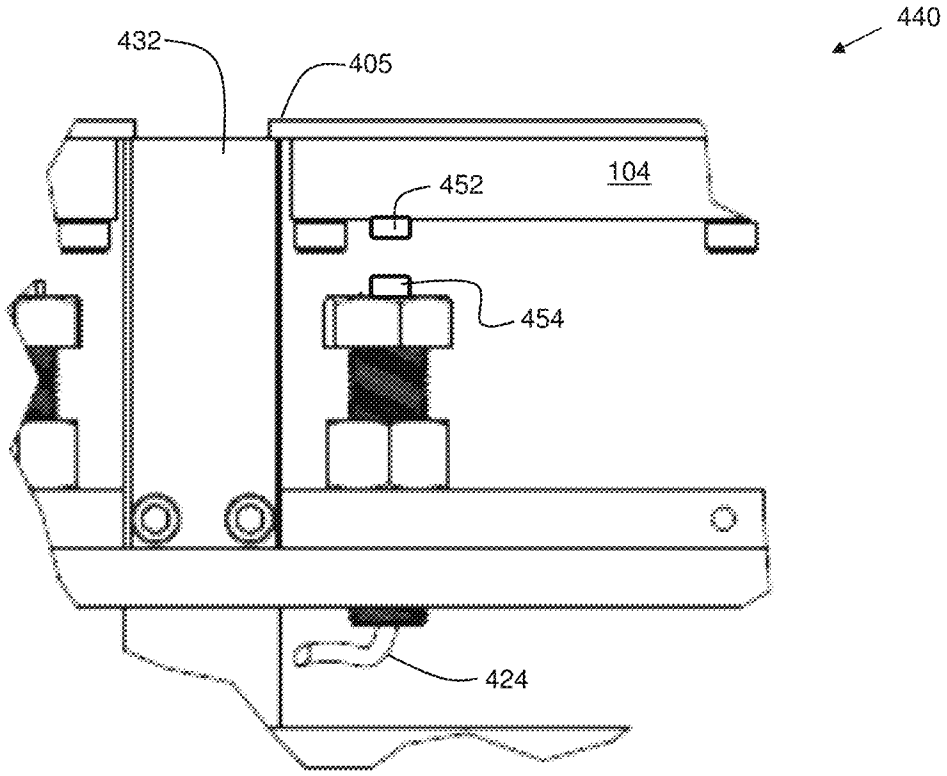
FIG. 4B shows additional detail of a fill sensor in an embodiment of the present invention.

FIG. 4B shows additional detail 440 of a fill sensor in an alternative embodiment of the present invention. Sensor 454 is a proximity sensor. When magnet 452 comes within a predetermined proximity to sensor 454, an electrical signal is transmitted via wire 424 to a controller, such as a microprocessor, microcontroller, programmable controller, or other suitable processor-based electronic device. This embodiment is contactless, and thus may provide improved reliability over the contact sensor. Thus, in embodiments, the sensor comprises a proximity sensor.

Figure 4C:
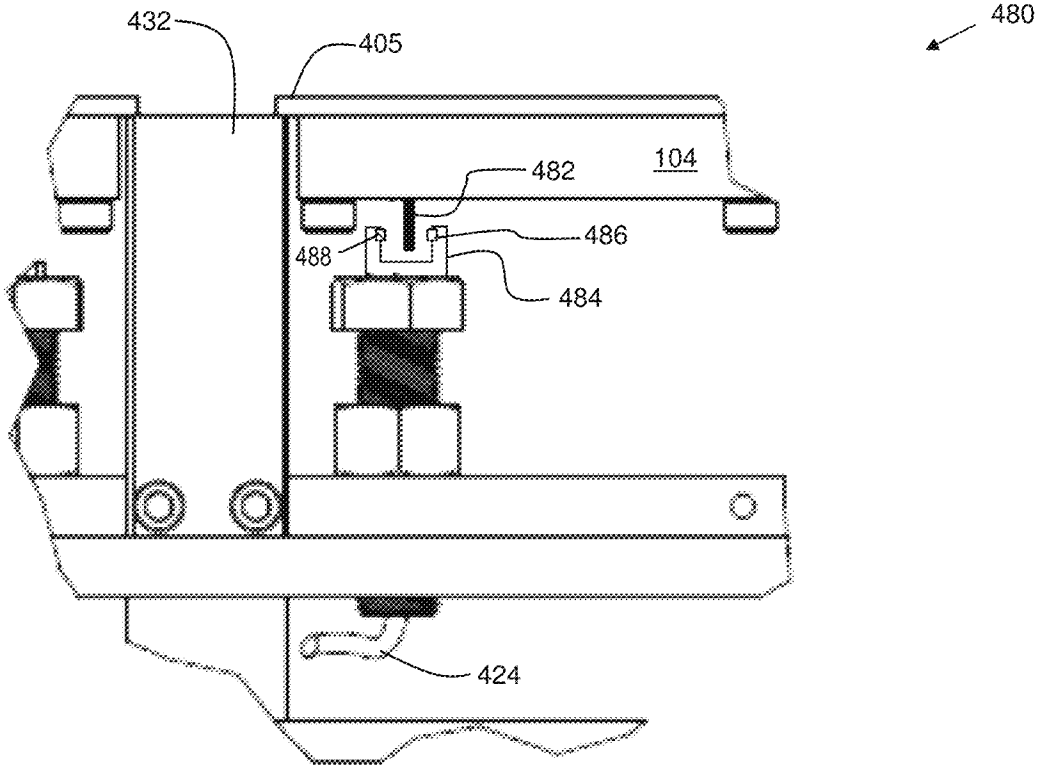
FIG. 4C shows additional detail of a fill sensor in an embodiment of the present invention.

FIG. 4C shows additional detail 480 of a fill sensor in another alternative embodiment of the present invention. Sensor 484 is an optical sensor. Flange 482 is affixed to the underside of the weigh plate 104. When flange 482 breaks the plane between optical transmitter 486 and optical receiver 488, an electrical signal is transmitted via wire 424 to a controller, such as a microprocessor, microcontroller, programmable controller, or other suitable processor-based electronic device. This embodiment is contactless. In embodiments, the sensor comprises an optical sensor.

The sensors of FIGS. 4A-4C are exemplary, and embodiments are not limited to these sensors. Other sensors now known or hereafter developed may also be used in embodiments of the present invention.

Figure 5A:
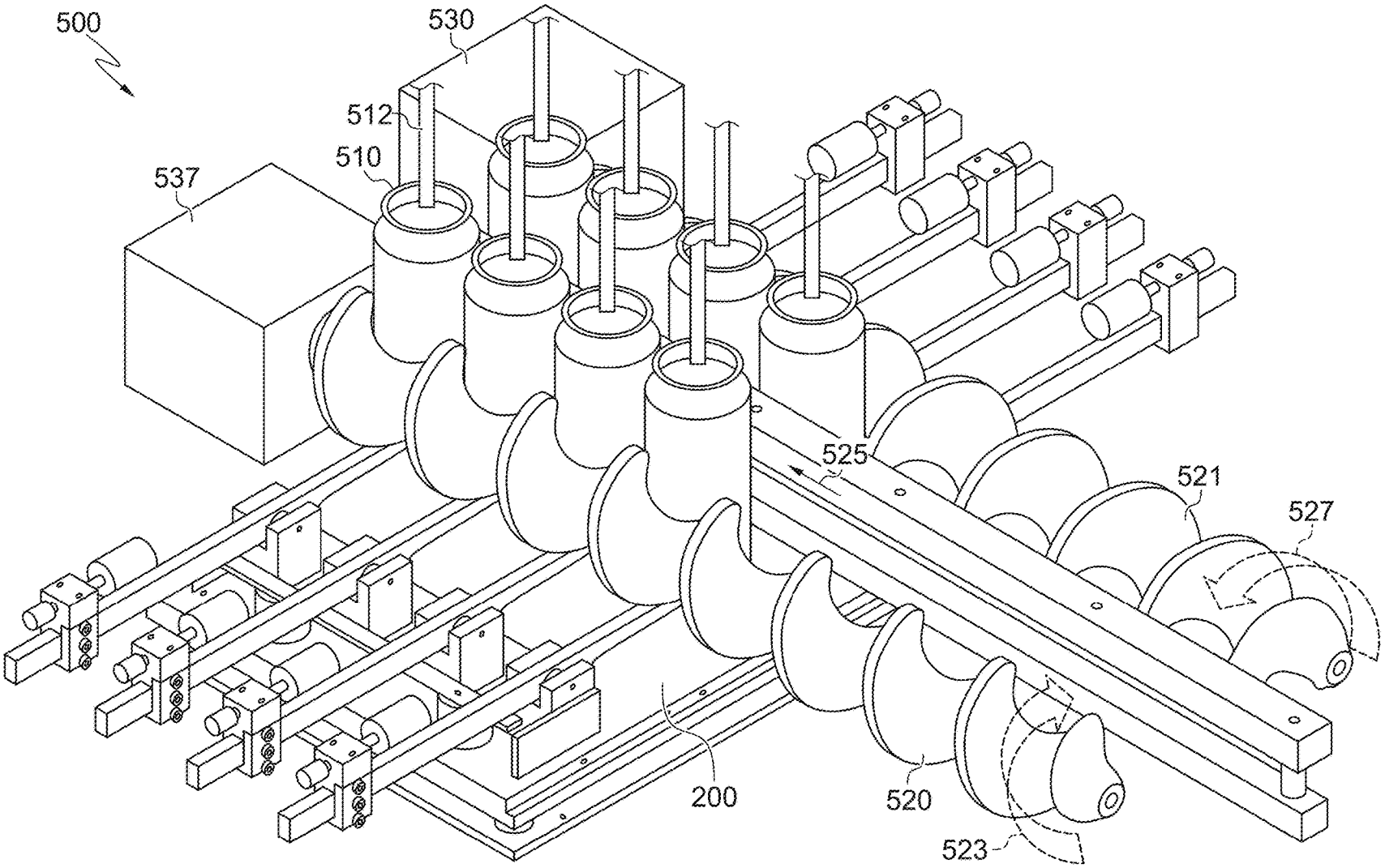
FIG. 5A shows a perspective view of a liquid product dispensing system in accordance with embodiments of the present invention.
Figure 5B:
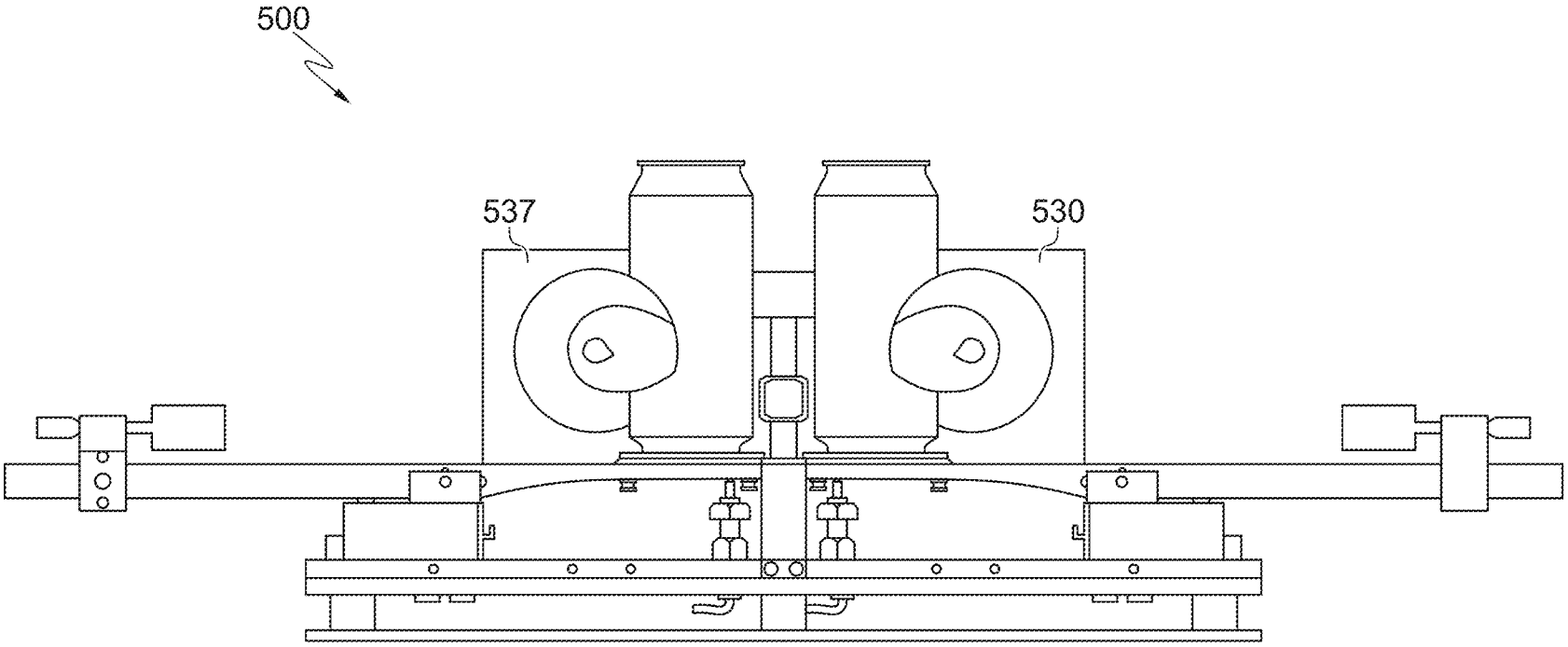
FIG. 5B shows a front view of the product dispensing system of FIG. 5A.

FIG. 5A shows a liquid product dispensing system 500 in accordance with embodiments of the present invention. FIG. 5B shows a front view of the product dispensing system of FIG. 5A as viewed facing the direction indicated by arrow 525. The bank 200 of balance apparatuses has feed screw 520 and feed screw 521 disposed thereon. A plurality of cans, an example of which is pointed out at 510, are engaged by the feed screws and disposed under dispensing tubes, an example of which is pointed out at 512. Each can of the plurality of cans 510 is on a balance apparatus similar to balance apparatus 100 of FIG. 1A, and each can 510 has a corresponding fill sensor (e.g. 240 of FIG. 2D) associated with it. As each sensor indicates a full can, dispensing for the corresponding tube 512 is terminated. When all eight sensors indicate dispensing complete, the transport system is activated by activating two motors that operate feed screws individually. In embodiments the motors may be servo motors. Motor 530 is mechanically coupled to feed screw 521. Motor 537 is coupled to feed screw 520. This allows feed screw 520 and feed screw 521 to be independently operated. The rotary motion of the motors advance feed screws 520 and 521. Feed screw 520 moves in the direction indicated by arrow 523, and feed screw 521 moves in the direction indicated by arrow 527, causing the cans 510 to move in the direction indicated by arrow 525. This takes the cans 510 off of the liquid product dispensing system, and on to subsequent stages in the canning process (e.g. lids, labeling, etc.). In embodiments, the transport mechanism comprises a feed screw. Other embodiments may utilize a different transport mechanism such as a conveyor belt, robotic pick-and-place arms, or other suitable transport mechanism.

Figure 6A:
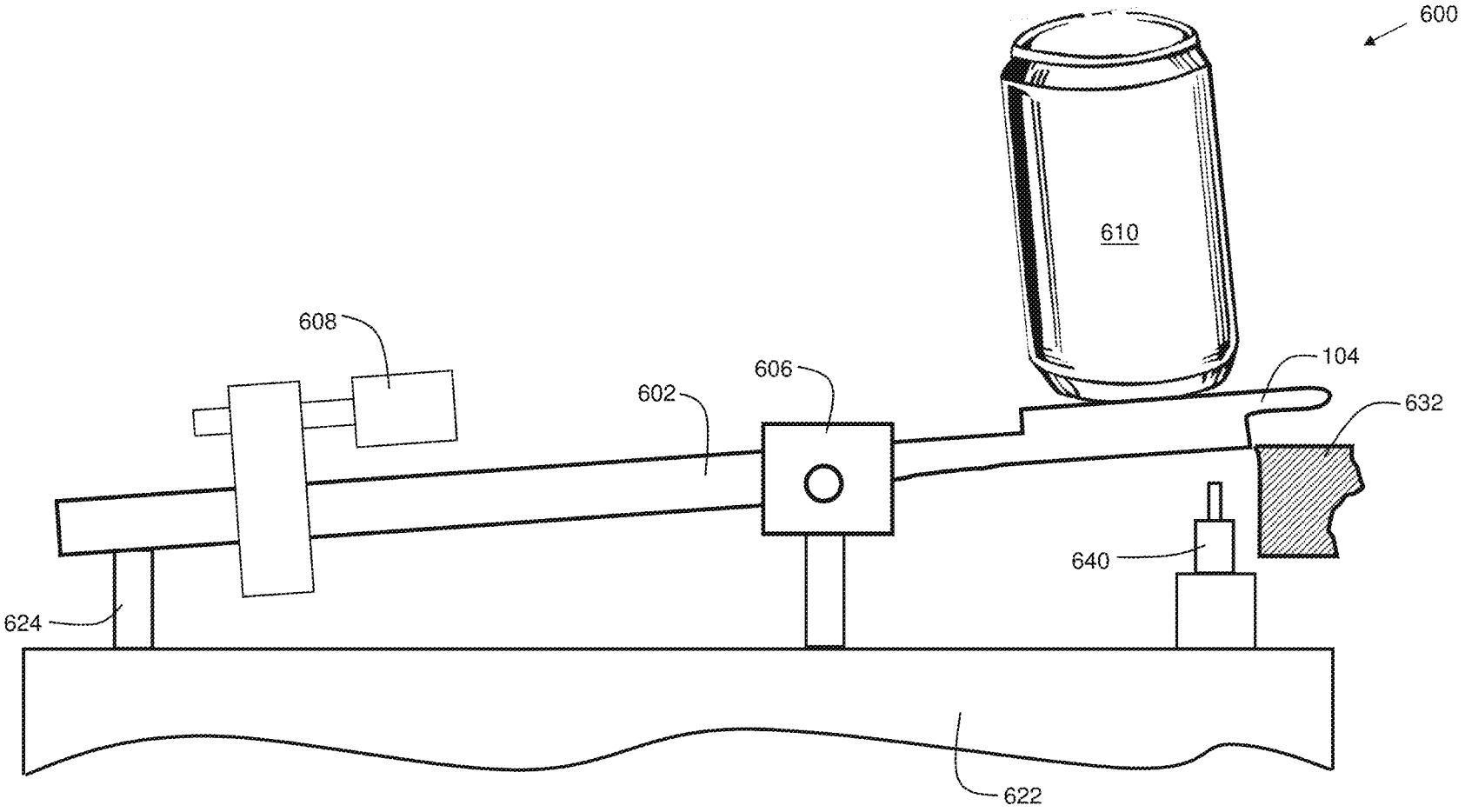
FIG. 6A shows details of a liquid product dispensing system in accordance with embodiments of the present invention with an empty can.

FIG. 6A shows details of a liquid product dispensing system 600 in accordance with embodiments of the present invention with an empty can 610. The counterweight 608 is set to a position along balance arm 602 such that, with the empty can 610, the counterweight causes the balance arm 602 to pivot about the fulcrum block 606 such that the weigh plate 104 rises up and does not make contact with sensor 640. The fulcrum block 606 and sensor 640 are disposed on base 622. A weigh plate lockdown mechanism comprises an actuator 624. The actuator 624 is used to secure the weigh plate 104 in a horizontal orientation for transporting cans on/off of the weigh plate. Thus, embodiments include a weigh plate lockdown mechanism configured and disposed to secure the weigh plate in a horizontal orientation. In embodiments, the weigh plate lockdown mechanism comprises an actuator configured and disposed to extend the balance arm on an opposite side of the fulcrum block from the weigh plate.

Figure 6B:
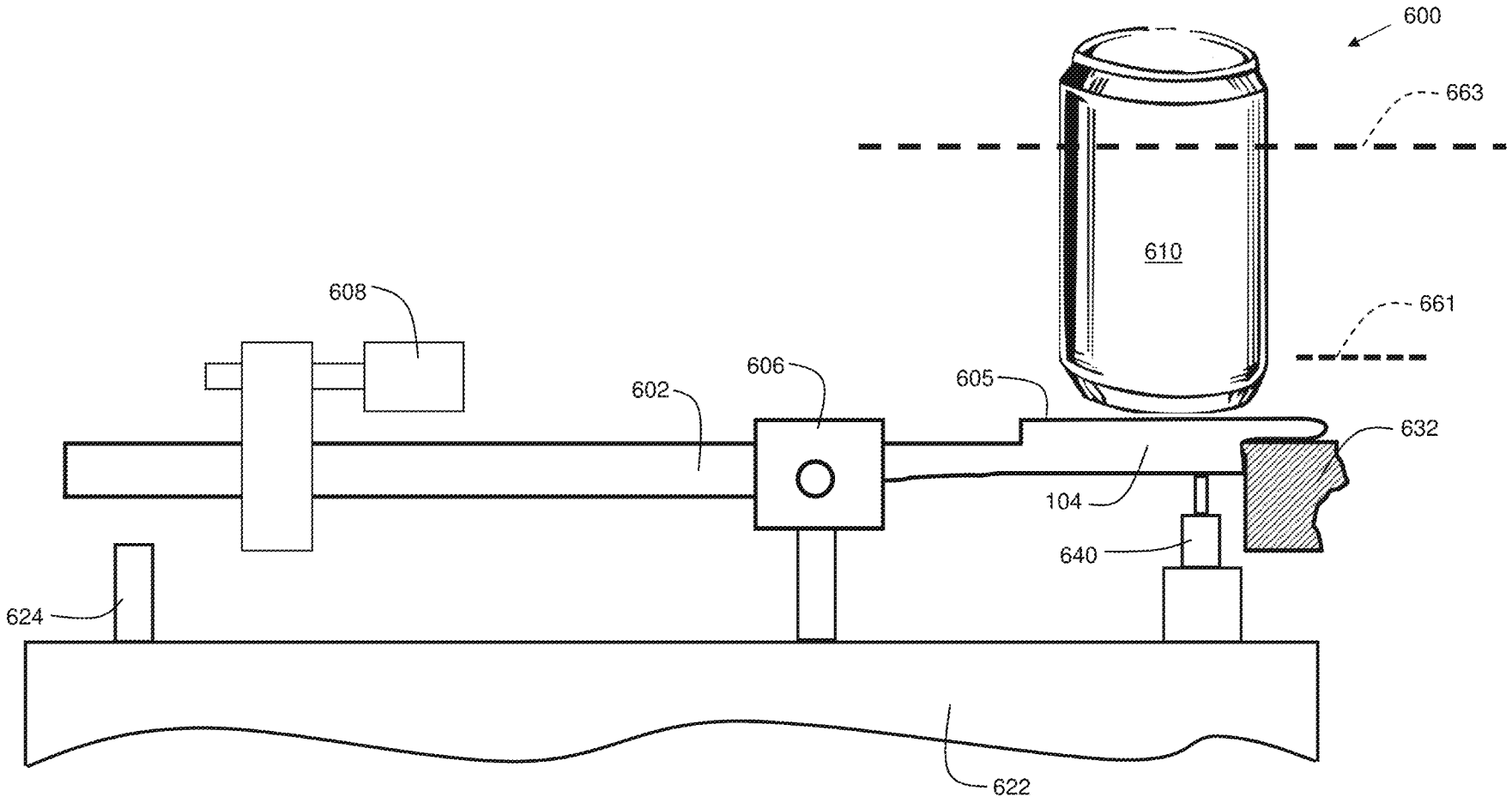
FIG. 6B shows details of a liquid product dispensing system in accordance with embodiments of the present invention with a full can.

FIG. 6B shows details of a liquid product dispensing system 600 in accordance with embodiments of the present invention with a full can. With the can 610 filled with product to fill line 663, the can is now heavy enough to cause the weigh plate 104 to contact the fill sensor 640. This causes an electrical signal to be generated, and the electrical signal is received by a controller to terminate dispensing upon receiving the electrical signal. The stopping block 632 limits the travel of the weigh plate 104 to a horizontal orientation, such that top surface 605 of the weigh plate 104 is parallel with horizontal axis 661.

Figure 6C:
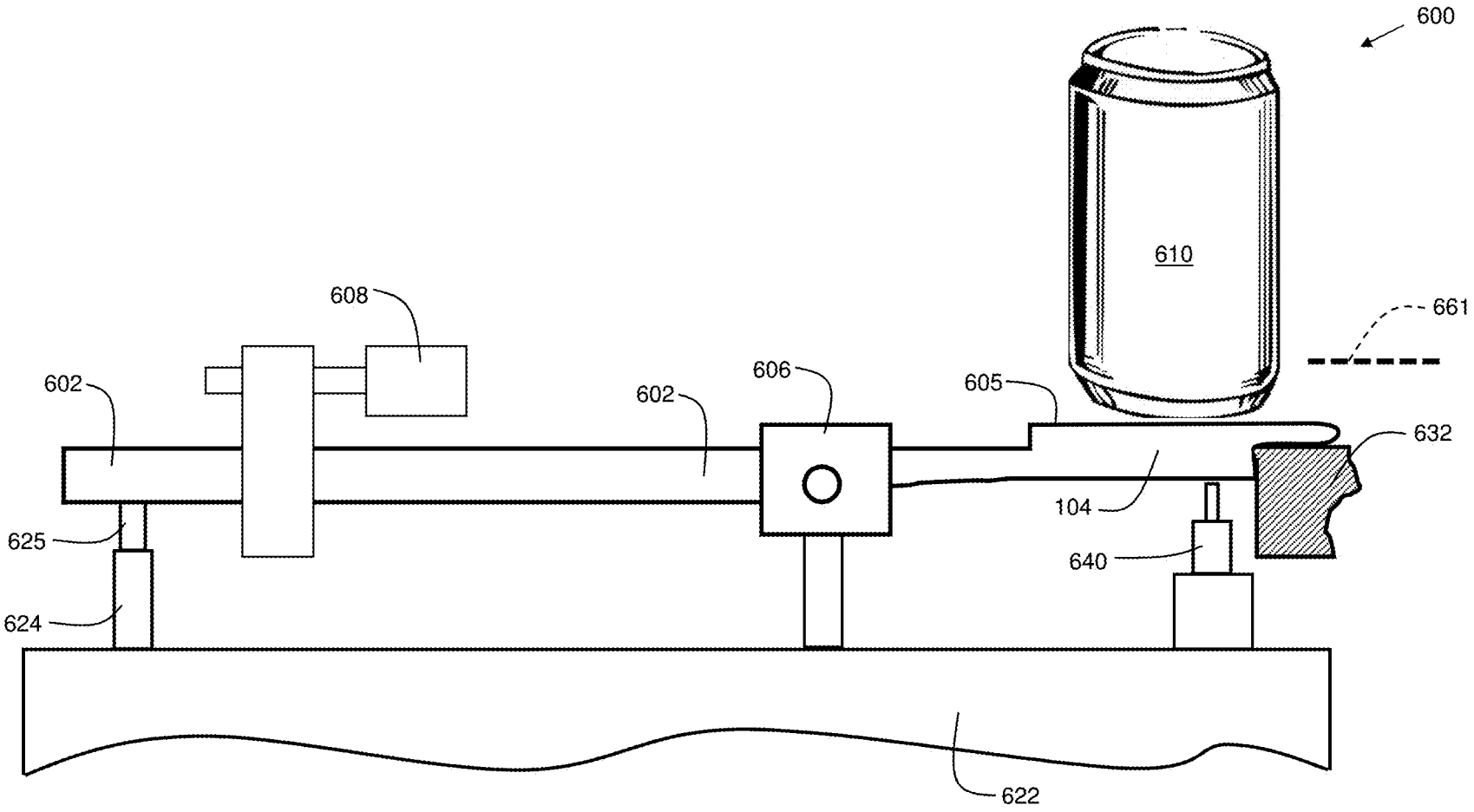
FIG. 6C shows details of a liquid product dispensing system in accordance with embodiments of the present invention with activation of the weigh plate lockdown mechanism.

FIG. 6C shows details of a liquid product dispensing system 600 in accordance with embodiments of the present invention with activation of the weigh plate lockdown mechanism. Before the can 610 is removed from the weigh plate 104 (e.g., by turning feed screw 520 of FIG. 5A), the actuator 624 moves extension 625 into place against balance bar 602, forcing top surface 605 of weigh plate 104 into a horizontal orientation, such that top surface 605 is parallel with horizontal axis 661.

Figure 6D:
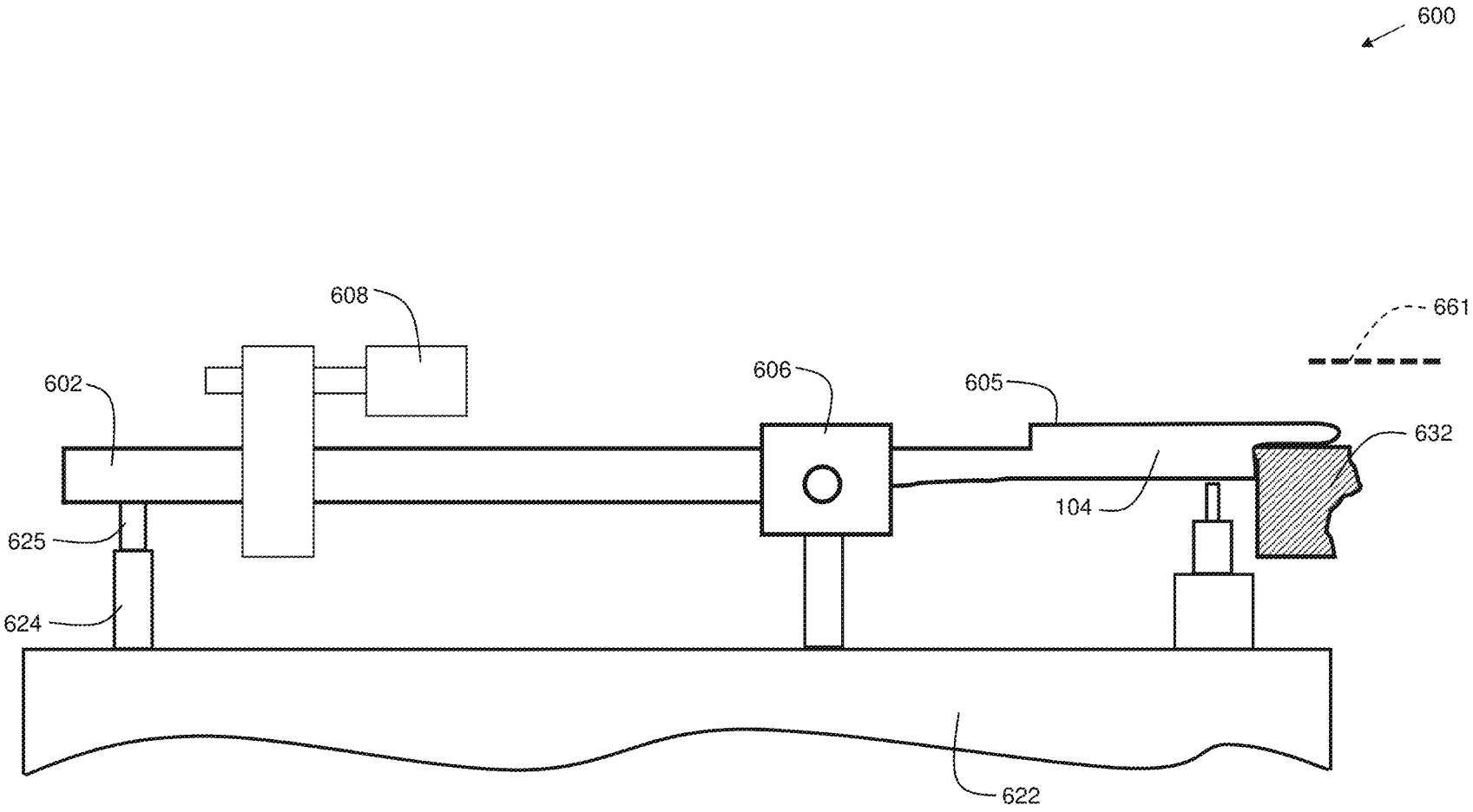
FIG. 6D shows details of a liquid product dispensing system in accordance with embodiments of the present invention with no can.

FIG. 6D shows details of a liquid product dispensing system 600 after removal of the full can. With the full can removed, the actuator 624 remains extended, and the weight plate 104 is now ready to receive another can via the transport mechanism.

Figure 7:
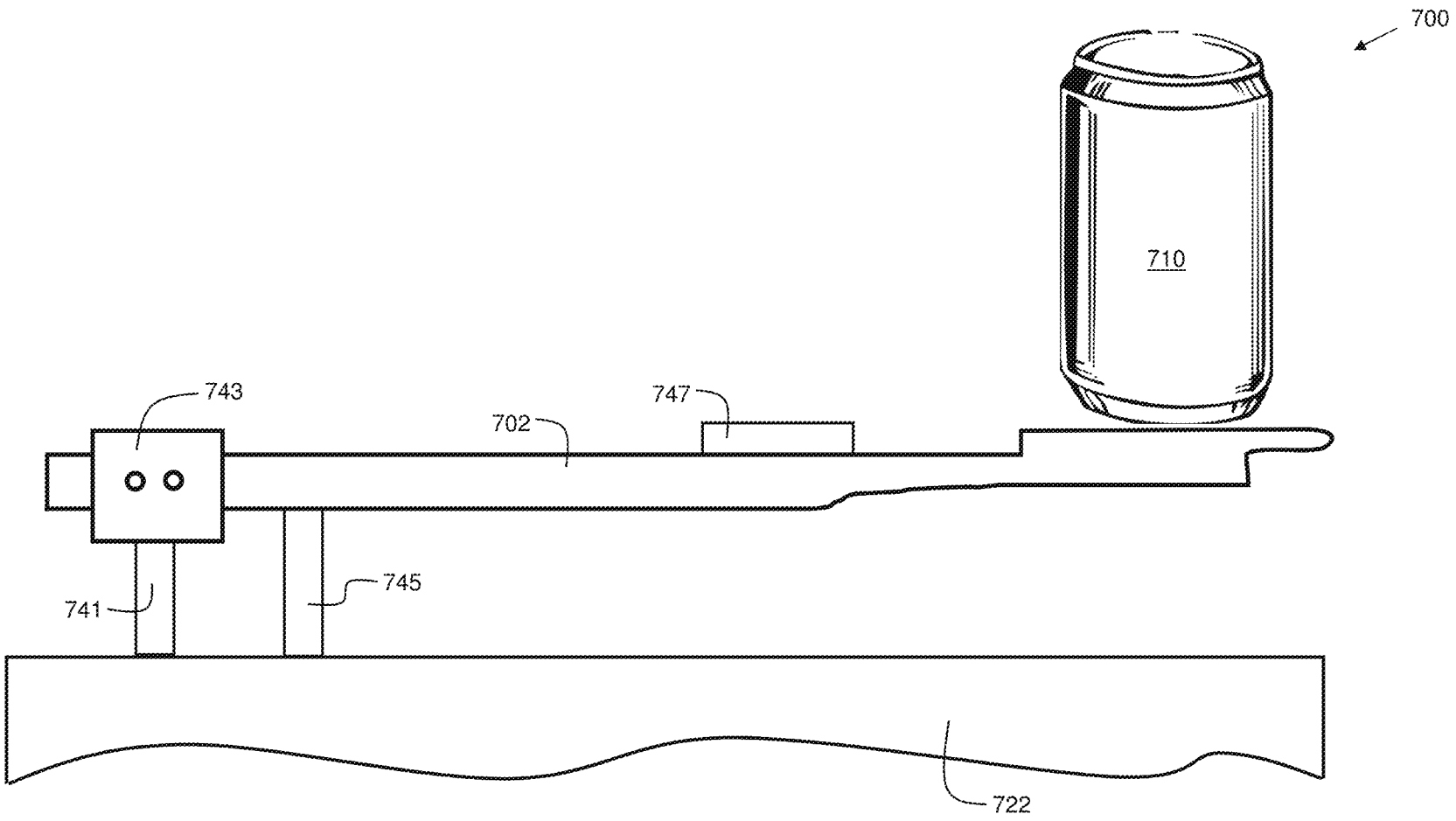
FIG. 7 shows details of a liquid product dispensing system in accordance with alternative embodiments of the present invention.

FIG. 7 shows details of a liquid product dispensing system 700 in accordance with alternative embodiments of the present invention. In this embodiment, arm 702 is affixed to block 743. Block 743 is affixed to post 741. Post 741 is affixed to base 722. Post 745 is affixed to base 722 adjacent post 741. Arm 702 cantilevers over post 745. A strain gauge 747 is affixed to the arm 702 and generates an electrical signal proportional to the downward force exerted by can 710. The system 700 is configured such that when the signal from strain gauge 747 indicates that can 710 is full, the dispensing of the can 710 is terminated. In this embodiment, there is no counterweight, and thus, this embodiment does not require counterweight adjustments.

Accordingly, embodiments include a liquid product dispensing system comprising a product weighing system. The product weighing system comprises a weigh plate, a strain gauge mechanically coupled to the weigh plate, and an electronic circuit configured and disposed to generate a trigger event in response to a predetermined strain indicated by the strain gauge. The liquid product dispensing system further comprises a dispensing system having a liquid dispensing port. The dispensing system is configured and disposed to stop dispensing upon detecting the trigger event from the electronic circuit.

Figure 8:
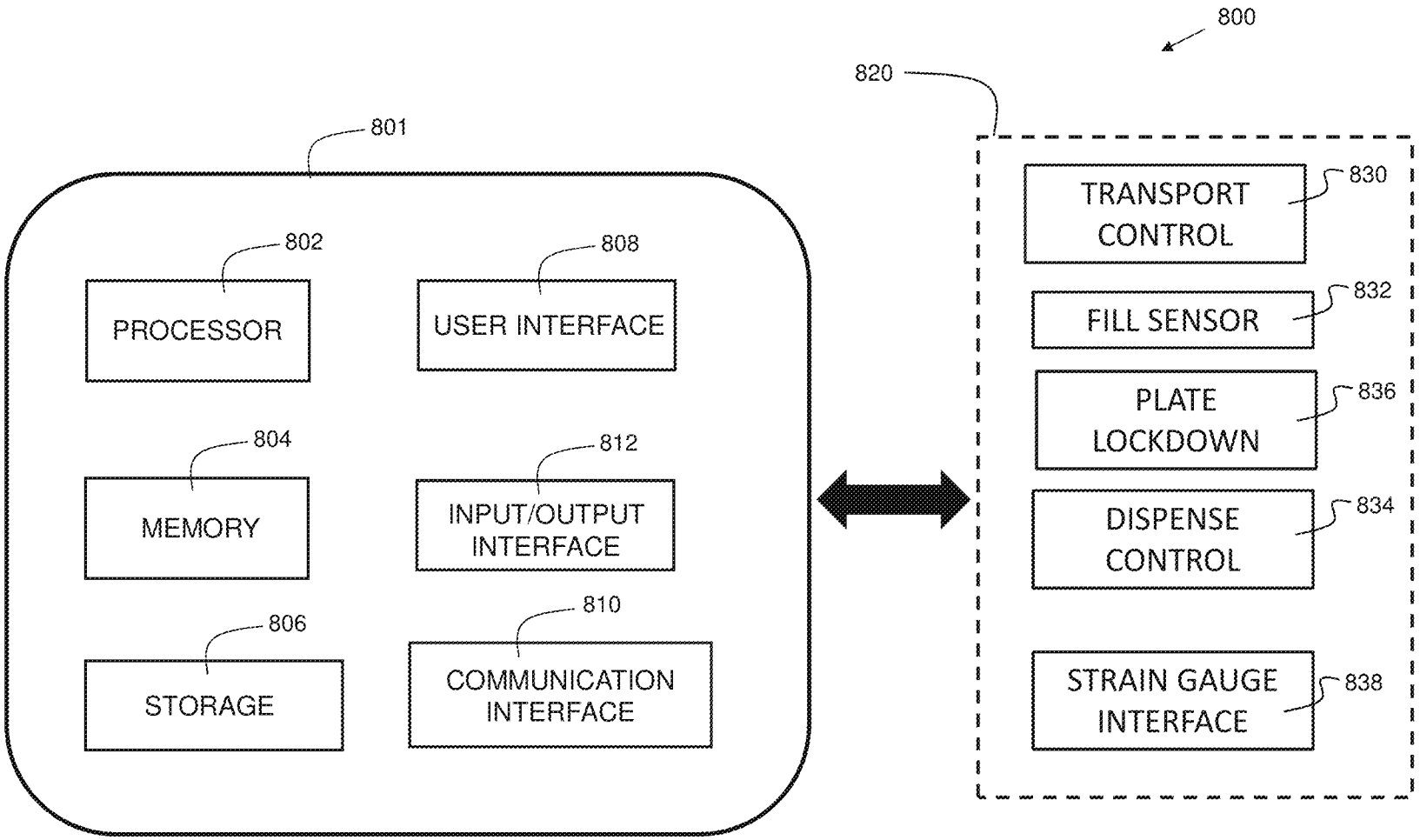
FIG. 8 shows a block diagram in accordance with embodiments of the present invention.

FIG. 8 shows a block diagram 800 in accordance with embodiments of the present invention. Controller 801 is an electronic computing device. Controller 801 includes a processor 802, and a memory 804 coupled to the processor 802. Memory 804 may include dynamic random-access memory (DRAM), static random-access memory (SRAM), magnetic storage, and/or a read only memory such as flash, EEPROM, optical storage, or other suitable memory. In some embodiments, the memory 804 may be a non-transitory computer readable hardware storage device. Memory 804 stores instructions, which when executed by the processor, implement steps of embodiments of the present invention.

Controller 801 further includes storage 806. In embodiments, storage 806 may include one or more magnetic storage devices such as hard disk drives (HDDs). Storage 806 may additionally include one or more solid state drives (SSDs).

Controller 801 further includes a user interface 808, examples of which include a liquid crystal display (LCD), a plasma display, a light emitting diode (LED) display, an organic LED (OLED) display, or other suitable display technology. The user interface 808 may further include a keyboard, mouse, or other suitable human interface device. In some embodiments, user interface 808 may be a touch screen, incorporating a capacitive or resistive touch screen in some embodiments.

Controller 801 further includes a communication interface 810. The communication interface 810 may be a wired communication interface that includes Ethernet, Gigabit Ethernet, or the like. In embodiments, the communication interface 810 may include a wireless communication interface that includes modulators, demodulators, and antennas for a variety of wireless protocols including, but not limited to, Bluetooth™, Wi-Fi, and/or cellular communication protocols for communication over a computer network.

Controller 801 further includes an input/output interface 812. Input/output interface 812 may include one or more input, output, and/or bidirectional pins to interface with peripheral system 820. Peripheral system 820 includes transport control 830. Transport control 830 includes motors, circuits, and/or logic to operate the transport system to move cans through the liquid product dispensing system.

Peripheral system 820 further includes fill sensor 832. Fill sensor 832 generates an electrical signal indicative of a full can. Peripheral system 820 further includes dispense control 834. Dispense control 834 includes motors, pumps, valves, circuits, and/or logic to operate the dispensing system top start and stop the flow of liquid product through the dispensing tubes (e.g. 512 of FIG. 5A).

Embodiments can include a controller configured and disposed to control the liquid product dispensing system. The controller comprises a processor; an input/output interface coupled to the processor; and a memory coupled to the processor. The memory contains instructions, that when executed by the processor, perform steps including: activating the weigh plate lockdown mechanism; operating a transport mechanism to place a can on the weigh plate; deactivating the weigh plate lockdown mechanism; starting product dispensing; in response to detecting a full condition, ending product dispensing; reactivating the weigh plate lockdown mechanism; and operating the transport mechanism to remove the can from the weigh plate.

Peripheral system 820 further includes plate lockdown module 836. Plate lockdown module 836 includes the circuitry and devices to secure the weigh plate in a horizontal orientation. In embodiments, the plate lockdown module 836 includes an actuator (such as actuator 624 of FIG. 6C).

In embodiments that include a strain gauge (e.g. 700 of FIG. 7), the peripheral system 820 may further include strain gauge interface 838. Strain gauge interface 838 comprises electronic circuits and/or digital logic to obtain an electric signal from the strain gauge that is indicative of a full condition of a can on a weigh plate. In strain gauge embodiments, the plate lockdown module 836 may or may not be present.

Figure 9:
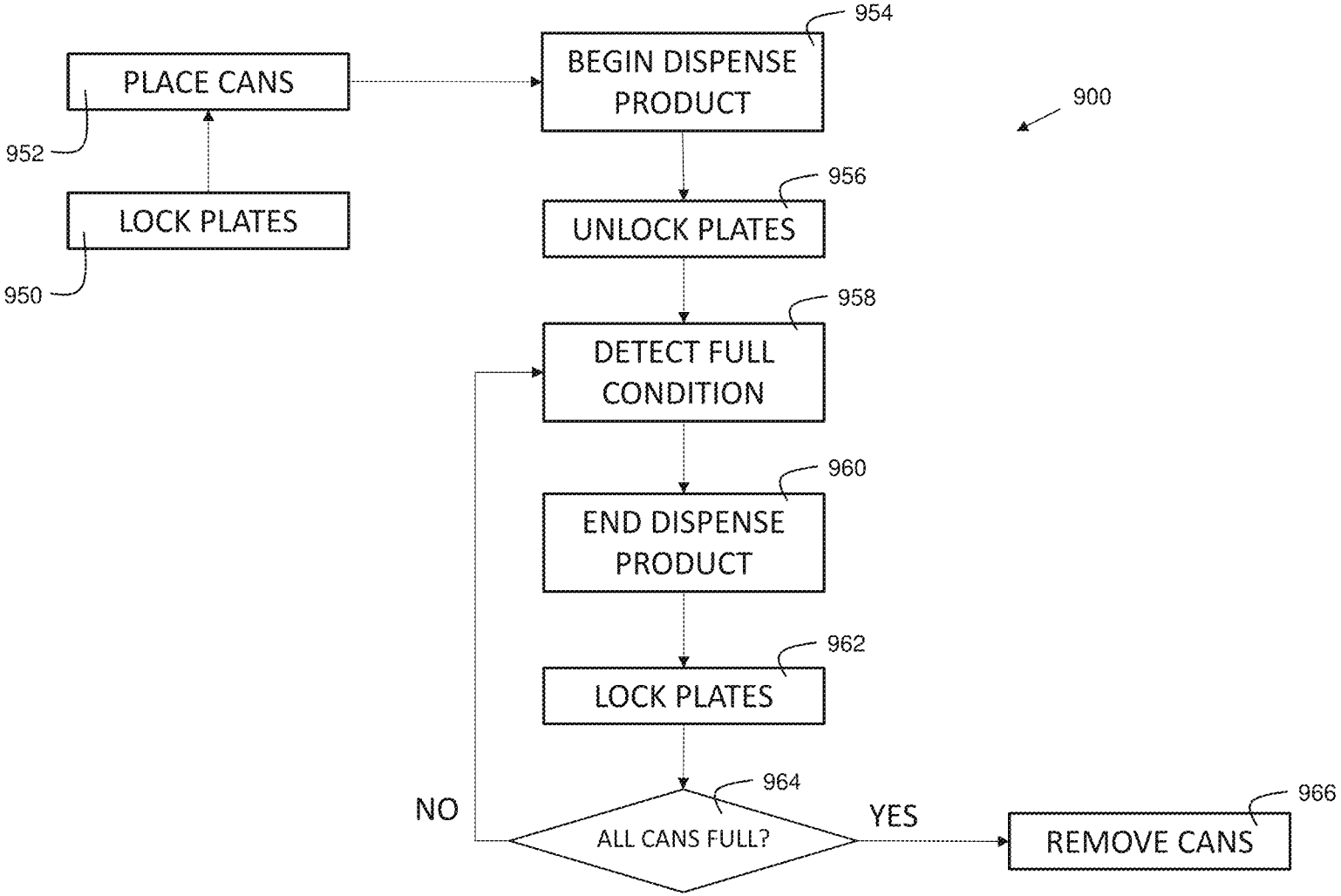
FIG. 9 is a flowchart indicating process steps for embodiments of the present invention.

FIG. 9 is a flowchart 900 indicating process steps for embodiments of the present invention. In process step 950, the weigh plates are locked. This configuration is shown in FIG. 6D. In process step 952, empty cans are placed on the weigh plates. This configuration is shown in FIG. 6C. In process step 954, product dispensing begins. In process step 956, the weigh plates are unlocked. This configuration is shown in FIG. 6A. In embodiments, liquid product from a pressurized source is fed through a dispensing tube into a can. In process step 958, a full condition is detected. This configuration is shown in FIG. 6B. In process step 960, the product dispensing ends. In process step 962, the weigh plate is again locked. In process step 964, a check is made to determine if all cans in the bank are full. If one or more cans are not yet full, the process returns to step 958. If all cans are full, the process continues to step 966 where the cans are removed from the liquid product dispensing system. Thus, embodiments include operating a transport mechanism to place a can of a selected volume (e.g., 12-ounce, 16-ounce, etc.) on the weigh plate; starting product dispensing; in response to detecting the trigger event, ending product dispensing; and operating the transport mechanism to remove the can from the weigh plate.

Figure 10:
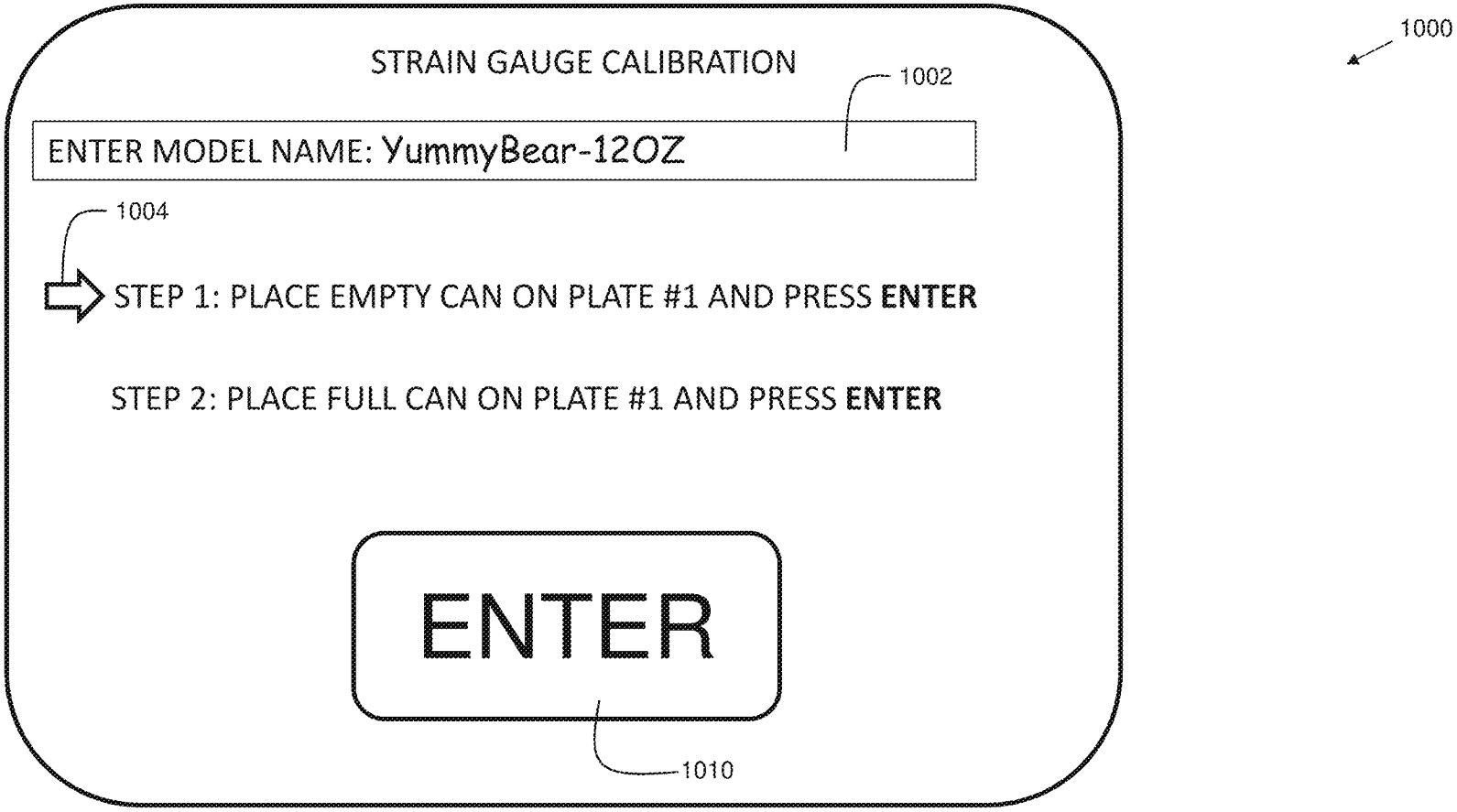
FIG. 10 is an exemplary user interface for embodiments of the present invention.

FIG. 10 is an exemplary user interface 1000 for embodiments of the present invention. The user interface 1000 may be used for embodiments utilizing a strain gauge, such as shown in FIG. 7. User interface 1000 shows a calibration/setup screen for embodiments of the present invention. In embodiments, for each weigh plate, a calibration procedure may be used to determine the electrical signal corresponding to an empty can, and the electrical signal corresponding to a full can. In embodiments, the user may be prompted to enter a model name in field 1002. The user is then prompted by cursor 1004 to perform the steps of placing an empty can on a particular weigh plate (plate #1 in the example of FIG. 10) and pressing enter 1010. Pressing enter 1010 causes the electrical signal generated by the strain gauge (747 of FIG. 7) corresponding to an empty can to be recorded to the storage (806 of FIG. 8) of the controller 801. The user is then prompted by cursor 1004 to perform the steps of placing a full can on a particular weigh plate (plate #1 in the example of FIG. 10) and pressing enter 1010. Pressing enter 1010 causes the electrical signal generated by the strain gauge (747 of FIG. 7) corresponding to a full can to be recorded to the storage (806 of FIG. 8) of the controller 801. This may be performed for all plates. Thus, in embodiments with 8 weigh plates, this procedure is performed 8 times. The user interface 1000 can guide an operator to perform empty and full can measurements on all weigh plates in the bank(s). The electrical signals may be associated with the model name specified in field 1002 and stored as a file, collection of files, or database in the storage 806 of controller 801. In embodiments, multiple models may be stored and/or retrieved. Thus, there can be models for 12-ounce, 16-ounce, and 20-ounce (fluid ounce) can sizes. Additionally, the density of the products may differ, such that a full can of one product may not have the same weight as the same number of fluid ounces (or milliliters) of another product. However, with embodiments of the present invention, models may be saved and later retrieved, allowing a manufacturing line to easily switch between different products during manufacturing. Thus, embodiments can include a controller configured and disposed to control the liquid product dispensing system. The controller comprises: a processor; an input/output interface coupled to the processor; a memory coupled to the processor, wherein the memory contains instructions, that when executed by the processor, perform steps including calibrating the strain gauge for a can volume.

As can now be appreciated, disclosed embodiments provide improvement in liquid product dispensing. Beverage cans are filled based on weight, rather than time, flow rate or fill sensor (conductivity). The fill rate is thus decoupled from the determination of the full condition. This can enable improved accuracy, resulting in less product discarding, thereby improving product yield, and thusly, improving profit margins for a beverage manufacturing operation. Although the aforementioned examples utilize cans, some embodiments may work with jars, bottles, and/or other suitable containers. Furthermore, while some embodiments may be used for liquid beverages such as beer, other embodiments may be used for powders, slurries, or other suitable products.

Reference throughout this specification to "one embodiment," "an embodiment," "some embodiments", or similar language means that a particular feature, structure, or characteristic described in connection with the embodiment is included in at least one embodiment of the present invention. Thus, appearances of the phrases "in one embodiment," "in an embodiment," "in some embodiments", and similar language throughout this specification may, but do not necessarily, all refer to the same embodiment.

Moreover, the described features, structures, or characteristics of the invention may be combined in any suitable manner in one or more embodiments. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, and/or elements.

Although embodiments of the invention have been described herein as systems and method, in some embodiments, the invention may include a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, may be non-transitory, and thus is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network (for example, the Internet, a local area network, a wide area network and/or a wireless network). The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device. Program data may also be received via the network adapter or network interface.

Computer readable program instructions for carrying out operations of embodiments of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of embodiments of the present invention.

These computer readable program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

While the invention has been particularly shown and described in conjunction with exemplary embodiments, it will be appreciated that variations and modifications will occur to those skilled in the art. For example, although the illustrative embodiments are described herein as a series of acts or events, it will be appreciated that the present invention is not limited by the illustrated ordering of such acts or events unless specifically stated. Some acts may occur in different orders and/or concurrently with other acts or events apart from those illustrated and/or described herein, in accordance with the invention. In addition, not all illustrated steps may be required to implement a methodology in accordance with the present invention. Furthermore, the methods according to the present invention may be implemented in association with the formation and/or processing of structures illustrated and described herein as well as in association with other structures not illustrated. Moreover, in particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. A liquid product dispensing system, comprising:

a balance apparatus, the balance apparatus comprising:

a balance arm;

a weigh plate disposed on a distal end of the balance arm;

a counterweight adjustably disposed on the balance arm;

a fulcrum block disposed at an intermediate position on the balance arm, wherein the balance arm is configured and disposed to pivot at the fulcrum block;

a weigh plate lockdown mechanism configured and disposed to secure the weigh plate in a horizontal orientation;

a sensor configured and disposed to generate a trigger event in response to a predetermined weight being loaded on the weigh plate; and a dispensing system comprising a liquid dispensing port, and wherein the dispensing system is configured and disposed to stop dispensing upon detecting the trigger event from the sensor.

2. The liquid product dispensing system of claim 1, wherein the sensor comprises a contact sensor.

3. The liquid product dispensing system of claim 1, wherein the sensor comprises a proximity sensor.

4. The liquid product dispensing system of claim 1, wherein the sensor comprises an optical sensor.

5. The liquid product dispensing system of claim 1, wherein the weigh plate lockdown mechanism comprises an actuator configured and disposed to contact the balance arm on an opposite side of the fulcrum block from the weigh plate.

6. The liquid product dispensing system of claim 1, further comprising a controller configured and disposed to control the liquid product dispensing system, the controller comprising:

a processor;

an input/output interface coupled to the processor;

a memory coupled to the processor, wherein the memory contains instructions, that when executed by the processor, perform steps including:

activating the weigh plate lockdown mechanism;

operating a transport mechanism to place a can on the weigh plate;

deactivating the weigh plate lockdown mechanism;

starting product dispensing;

in response to detecting a full condition via the input/output interface, ending product dispensing;

reactivating the weigh plate lockdown mechanism; and operating the transport mechanism to remove the can from the weigh plate.

7. The liquid product dispensing system of claim 6, wherein the transport mechanism comprises a feed screw.

8. A liquid product dispensing system, comprising:

a balance apparatus, the balance apparatus comprising:

a balance arm;

a weigh plate disposed on a distal end of the balance arm;

a counterweight adjustably disposed on the balance arm;

a fulcrum block disposed at an intermediate position on the balance arm, wherein the balance arm is configured and disposed to pivot at the fulcrum block;

a stopping block configured and disposed to prevent downward travel of the weigh plate when the weigh plate is in a horizontal orientation;

a sensor configured and disposed to generate a trigger event in response to a predetermined weight being loaded on the weigh plate; and a dispensing system comprising a liquid dispensing port, and wherein the dispensing system is configured and disposed to stop dispensing upon detecting the trigger event from the sensor.

9. A liquid product dispensing system, comprising:

a balance apparatus, the balance apparatus comprising:

a balance arm;

a weigh plate disposed on a distal end of the balance arm;

a counterweight adjustably disposed on the balance arm;

a fulcrum block disposed at an intermediate position on the balance arm, wherein the balance arm is configured and disposed to pivot at the fulcrum block;

a sensor configured and disposed to generate a trigger event in response to a predetermined weight being loaded on the weigh plate; and a dispensing system comprising a liquid dispensing port, and wherein the dispensing system is configured and disposed to stop dispensing upon detecting the trigger event from the sensor;

wherein the counterweight is coupled to a slide block, wherein the slide block is configured and disposed to adjustably attach to the balance arm.

10. The liquid product dispensing system of claim 9, further comprising a screw coupled to the counterweight and the slide block, wherein the screw is configured and disposed to adjust a position of the counterweight relative to the fulcrum block.

11. The liquid product dispensing system of claim 10, wherein the screw has a thread count ranging from 20 threads per inch to 40 threads per inch.

12. The liquid product dispensing system of claim 1, wherein the weigh plate has a rectangular top surface.

13. The liquid product dispensing system of claim 12, wherein the weigh plate top surface has a surface area ranging from 9 square inches to 16 square inches.

14. A computer-implemented method for dispensing liquid product, comprising:

activating a weigh plate lockdown mechanism for a weigh plate;

operating a transport mechanism to place a can on the weigh plate;

deactivating the weigh plate lockdown mechanism;

starting product dispensing into the can;

in response to detecting a full condition for the can, ending product dispensing;

reactivating the weigh plate lockdown mechanism; and operating the transport mechanism to remove the can from the weigh plate.

* * * * *